US006094126A

United States Patent [19]

Sorenson

[11] Patent Number: 6,094,126

[45] Date of Patent: Jul. 25, 2000

[54] THERMAL CIRCUIT BREAKER SWITCH

[76] Inventor: Richard W. Sorenson, 6540 SE. Harbor Cir., Stuart, Fla. 34996

[21] Appl. No.: 09/328,107

[22] Filed: Jun. 8, 1999

[51] Int. Cl.[7] ..... H01H 37/02; H01H 37/32; H01H 37/46; H01H 37/52

[52] U.S. Cl. ..... 337/37; 337/38; 337/39; 337/59; 337/85; 337/112; 337/113; 337/334

[58] Field of Search ..... 337/334, 333, 337/343, 370, 374, 376, 377, 381, 141, 161, 23, 36, 37, 32, 38, 39, 59, 85, 66, 79, 100, 102, 140, 91, 75, 741, 67–69, 53, 345, 112, 113; 200/553–557; 29/622

[56] References Cited

U.S. PATENT DOCUMENTS

| | | | |
|---|---|---|---|
| 4,337,450 | 6/1982 | Matthies | 337/66 |
| 4,345,233 | 8/1982 | Matthies | 337/75 |
| 4,363,016 | 12/1982 | Unger | 337/56 |
| 4,528,538 | 7/1985 | Andersen | 337/43 |
| 4,559,510 | 12/1985 | Franz . | |
| 5,012,495 | 4/1991 | Munroe et al. | 337/3 |
| 5,079,530 | 1/1992 | Tsuchiyama | 335/17 |
| 5,089,799 | 2/1992 | Sorenson | 337/68 |
| 5,262,748 | 11/1993 | Tsung-Mou | 337/66 |
| 5,453,725 | 9/1995 | You et al. | 337/68 |
| 5,786,742 | 7/1998 | Yin | 337/66 |
| 5,828,284 | 10/1998 | Huang | 337/37 |
| 5,892,426 | 4/1999 | Huang | 337/59 |
| 5,898,355 | 4/1999 | Yu | 337/8 |

FOREIGN PATENT DOCUMENTS

| | | | |
|---|---|---|---|
| 63-269431 | 11/1988 | Japan | H01H 73/00 |

*Primary Examiner*—Leo P. Picard
*Assistant Examiner*—Anatoly Vortman
*Attorney, Agent, or Firm*—McCormick, Paulding & Huber LLP

[57] ABSTRACT

The thermal circuit breaker and switch has fixed and movable contacts, and non-conductive contact and trip actuators. The movable contact is provided on the free end of a lever arm that normally biases the movable contact toward its open position. The contact actuator transfers movement from a rocker or operator to the movable contact arm when no overload condition exists. The trip actuator is L shaped and rotates in a socket when engaged by a thermally sensitive bi-metallic element so as to allow one end of the contact actuator to float freely, allowing the movable contact arm's bias to open the circuit. The bi-metallic element is so positioned as to engage and rotate the trip actuator only when the bi-metallic element is deformed due to an overheat condition that occurs with an overcurrent. A compression spring acts between the upstanding legs of the trip actuator and the underside of the rocker thus biasing the rocker to the 'off' position and biasing the trip actuator to the 'reset' position.

20 Claims, 15 Drawing Sheets

THERMAL CIRCUIT BREAKER SWITCH

BACKGROUND OF THE INVENTION

1. Field of the Invention

The present invention relates to thermal circuit protector devices which also function as ON/OFF switches, and deals more particularly with a structure that is simpler and less expensive to manufacture. The thermal circuit protector/switch structure also prevents a continuance or a cycling of an overload condition in the event manual override is attempted.

2. Description of the Prior Art

Switches for use either as a thermal protector circuit breaker or switch are known. Snap action bi-metallic elements have been embodied in similar thermal protectors which employ a flag of insulating material to project between the switch contacts when the bi-metal element senses an overload condition. See U.S. Pat. Nos. 5,089,799 and 5,264,817 for examples of thermal protective switches of the type utilizing such a flag.

Other thermal protective devices that serve a switch function operate via a push button action, and require that the push button be manually pulled out after the device trips the circuit in order to reset the circuit protector. Butler, U.S. Pat. No. 3,311,725 illustrates a circuit breaker/switch of this general type.

Still other thermostatic switches have a snap action disc that can be reset by a push button. See U.S. Pat. Nos. 4,791,397 and 4,628,295 for examples of disc type devices.

Although much more complicated and therefore more expensive to manufacture, thermal circuit breakers are also known. See U.S. Pat. Nos. 4,931,762; 4,937,548; and 4,258,349 for examples.

Another version of a thermal circuit breaker and switch, by the same inventor herein, uses the bi-metal element as the contact arm. See U.S. Pat. No. 5,847,638.

Still another approach to providing a rocker switch style thermal circuit breaker is shown in U.S. Pat. No. 5,491,460. However, this patent, like others of its type, requires many metal components, and metal spring elements to achieve the 'trip free' operation necessary in such protective breakers. See also U.S. Pat. Nos. 5,889,457 and 5,451,729 wherein many specially formed metal components and springs are required to provide a trip free rocker switch style thermal breaker.

The general purpose of the present invention is to provide a thermal circuit breaker and switch that does not require a flag, and has both the appearance and functional capability of a conventional rocker switch, and wherein the device is also capable of "trip free" operation so that even if manually held in the 'on' or closed position, will not result in re-closing of the contacts and hence reheating of the bi-metal. The present invention avoids the stresses imposed on the bi-metal element when used as a contact arm although the bi-metal is provided in the circuit path. Individual contact and trip actuators are provided to avoid stressing the bi-metal, thus improving both accuracy and stability of operation. While slightly more complicated and expensive than the embodiment using the bi-metal as the contact arm, this invention remains less expensive to manufacture than other thermal circuit breaker designs which have the bi-metal separate from the contact.

SUMMARY OF THE INVENTION

In accordance with the present invention, a molded hollow housing of either single body or split case construction is provided with a bottom wall and defines a top opening for pivotally receiving a rocker or bat type operator. The housing interior has a sidewall defining at least one vertical track to movably receive a contact actuator. An integrally molded socket pivotally receives and supports a trip actuator. The housing bottom wall is fitted with fixed line and load terminals. The rocker includes an extension or depending post that projects inside said housing and engages the contact actuator. A single compression spring biases the rocker toward the 'off' position and biases the trip actuator toward the normal position.

One end of a movable conductive contact arm is fixedly mounted to a conductive jumper plate or directly connected to one arms of a bi-metallic element, which is electrically connected to the load terminal. An opposite free end of the contact arm carries a movable contact element and is biased toward a contact actuator to normally urge said movable contact element away from a fixed contact element mounted to the line terminal.

The contact actuator includes lateral projections that are slideable in said housing vertical track, such that movement of the rocker also moves the movable contact arm at least when the present invention is operated as a switch and there is no overload condition.

A trip is provided that actuator is 'L' shaped and has upstanding and vertical legs that are fixedly joined at adjacent ends. The 'L' shaped trip actuator is pivotally supported at this juncture in a socket defined for it in the housing. The horizontal leg has projecting pins received in vertical tracks in the housing and the upstanding vertical leg engages said contact actuator via interfacing surfaces on both the contact actuator and the trip actuator. In response to an overcurrent a bi-metallic element moves into engagement with the horizontal leg of the trip actuator, pivoting the trip actuator and thereby disengaging the end of the contact actuator from the trip actuator. This allows the movable contact arm's inherent bias to open the contacts as a result of the overcurrent condition in the bi-metallic element.

The bi-metallic element is 'U' shaped having the end of one arm of the U fixedly connected to the load terminal, and the end of an opposing arm fixedly connected to the contact arm, either directly or through a conductive jumper. The bi-metallic element electrically connects the load terminal to the movable contact arm and its movable contact. The bi-metallic element exhibits a thermally responsive change in shape or curvature such that the unrestrained free end base of the 'U' will bend upwardly toward the trip actuator in response to a predetermined current generating a temperature rise of the bi-metallic element.

Biasing means in the form of a single compression spring is provided between the underside of the rocker and the upper end of the trip actuator's vertical leg. Thus, a single spring biases both the rocker to its 'off' position and the trip actuator to its normal position engaging the contact actuator in the absence of an overload condition. Even if the rocker is held in the 'on' position, the rocker's lower extension cannot cause the contact actuator to move the movable contact arm into a contact closed condition since one end of the contact actuator is not constrained by engagement with the trip actuator. When the rocker is not held to the 'on' position during this overload condition, the spring bias forces said rocker toward the 'off' position. Once the bi-metallic element has cooled sufficiently so that it no longer abuts the trip actuator, the spring returns the trip actuator to the normal position such that its vertical leg again may engage the contact actuator.

BRIEF DESCRIPTION OF THE DRAWINGS

A more complete understanding of the invention and its attendant advantages will be readily realized by reference to the following detailed description considered in conjunction with the accompanying drawings. Corresponding reference characters indicate corresponding components of the several drawings, and.

DETAILED DESCRIPTION OF THE DRAWINGS

Figure 1:
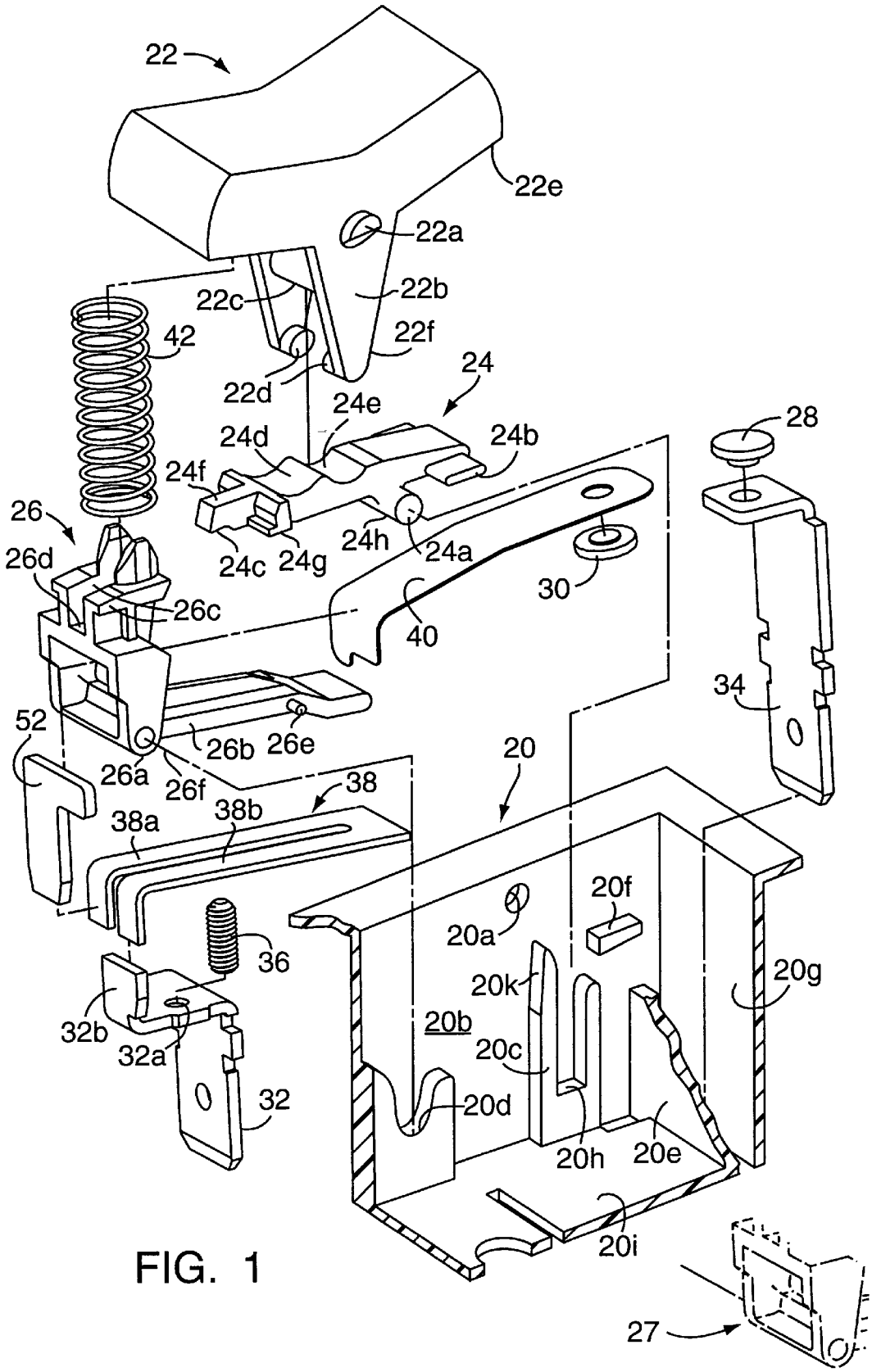
FIG. 1 is an exploded view of the preferred embodiment of the invention.

Referring now to the drawings in greater detail, FIG. 1 shows a molded hollow housing 20 of the type having a generally rectangular upwardly open cavity for containing the following components. A pivotally mounted rocker 22 or other operator has laterally extending axle defining projections 22*a* received in axle openings 20*a* in the housing sidewalls 20*b*. Housing sidewalls 20*b* have molded vertical tracks 20*c* for slideably receiving track guide projections 24*a* on a contact actuator 24. The track also defines a bottom surface 20*h* for a projecting pin 26*e* on a trip actuator 26. The housing sidewalls 20*b* also define sockets 20*d* to receive axle defining projections 26*a* on the trip actuator. Thus, the trip actuator 26 is pivotally mounted in the housing 20. An integrally molded barrier 20*e* in the housing insulates a terminal element 34 that has a fixed contact 28 mounted on the end of said terminal element 34. The housing 20 also defines a housing stop 20*f* to abut an actuator stop 24*b* on the contact actuator 24, and thereby limit said actuator's upward movement. The stop projection 20*f* provides a pivot point to cause the opposite end of the contact actuator to rise above the engaging surface of the trip actuator due to the pressure exerted against the contact actuator by the upward bias of the contact arm.

Figure 11:
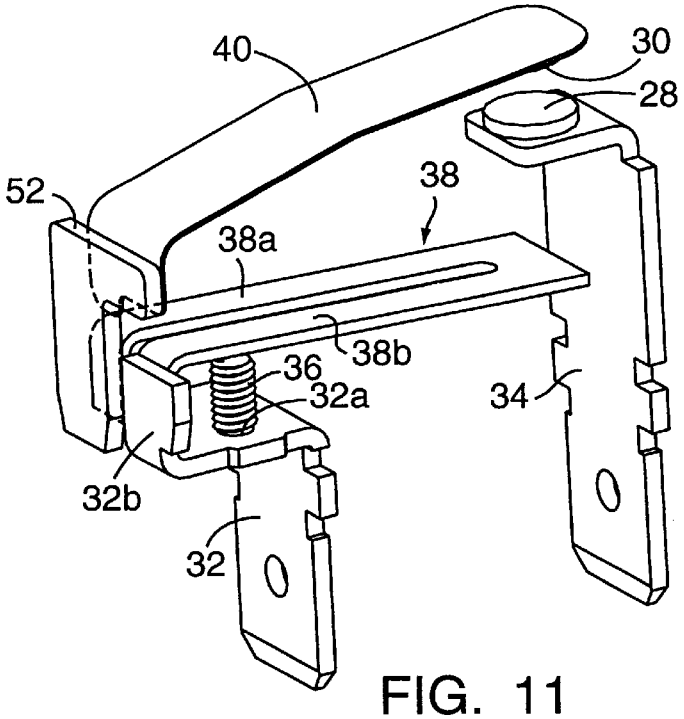
FIG. 11 is a perspective view of the electrically conductive components in isolation.

A load and a line terminal (32 and 34, respectively) extend through slots in a housing bottom wall 20*i*. The load terminal 32 incorporates a threaded opening 32*a* which accepts an adjustment or calibration screw 36. The load terminal 32 extends upwardly along a housing end wall an upper end 20*g* and an upper end connects with one arms of a bi-metallic element 38. The element 38 is shown in FIG. 11 to have a "U" shape having a base and parallel arms 38*a* and 38*b*, and is oriented in a plane roughly parallel to the housing bottom wall 20*i*. The bi-metallic element 38 has a thermally responsive character such that a rise in temperature, as in an overcurrent condition, causes the bi-metallic element to curve towards the trip actuator 26. The end of the calibration screw 36 contacts the lower surface of the bi-metallic element 38 to define the normal configuration for the element 38, and hence the extent of the deformation thereof that is required to trip the trip actuator 26. The "U" shaped bi-metallic element has the end of one arm 38*a* connected to the fixed end of a movable contact arm 40. Preferably a conductive jumper 52 connects the one bi-metallic element arm to said movable contact arm. Optionally, the bi-metallic element may be directly connected to the movable contact arm. The opposing arm 38*b* of the bi-metallic element is connected to an offset 32*b* of the load terminal 32 so that current flows through the bi-metallic element 38. The movable contact arm 40 is composed of a spring metal material and includes a contact movable element 30 at its free end which is biased upward and away from the fixed contact element 28. The fixed contact element 28 is mounted on the line terminal 34 and so positioned that when the movable contact arm 40 is forced downward by the contact actuator, the movable contact element 30 closes the circuit with contact 28. The line terminal 34 is mounted abutting the housing end wall 20*g* opposite the load terminal offset 32*b*.

The rocker or operator 22 pivotally mounted in the housing axle openings 20*a* is biased by a spring 42 to the open-circuit or 'off' position. An integrally molded extension 22*b* or depending post is provided in said rocker and is oriented roughly vertically when the rocker 22 is in the 'on' position. (See FIG. 8). A rocker extension lower surface 22*c* movably engages a contact actuator upper surface 24*d*. Preferably, the rocker also has extensions below the contact actuator 24, with one or more inward facing projections 22*d*. These projections 22*d* engage part of the lower surface of the contact actuator 24 at a reset surface 24*g* to assure the resetting of the end with a notch 24*f* above a slotted trip stop surface 26*d* when the thermal protector is in the 'off' position.

The contact actuator 24 is provided between the upwardly biased movable contact arm 40 and the rocker 22. A contact stop 24*b* abuts the housing stop 20*f* at the housing sidewall to limit upward movement of the right end (as shown) and cause a pivoting motion to effect the upward movement of the notched end 24*f*. In the 'off' position, the rocker's surface 22*c* provides a limit stop to the upward movement of the contact actuator on surface 24*d*. This upward movement is effected by the upward biasing pressure of the contact arm against a pressure point surface 24*h* of the contact actuator. The rocker 22 is biased to the 'off' position by the spring 42 and is stopped in the appropriate 'off' position by the housing stop 20*f* abutting an 'off' stop surface 22*e*. In the 'on' position the detent in the top surface of the contact actuator at 24*e* latches the rocker's lower surface 22*c* with sufficient pressure provided by the upward bias of the contact arm 40 to overcome the rocker's minimal bias to the 'off' position as effected by spring 42. The rocker is thereby held in the 'on' position and stopped at the appropriate 'on' position by a track exterior sidewell 20*k* molded into the housing 20 which will abut the rocker at an 'on' stop surface 22*f*.

Figure 7:
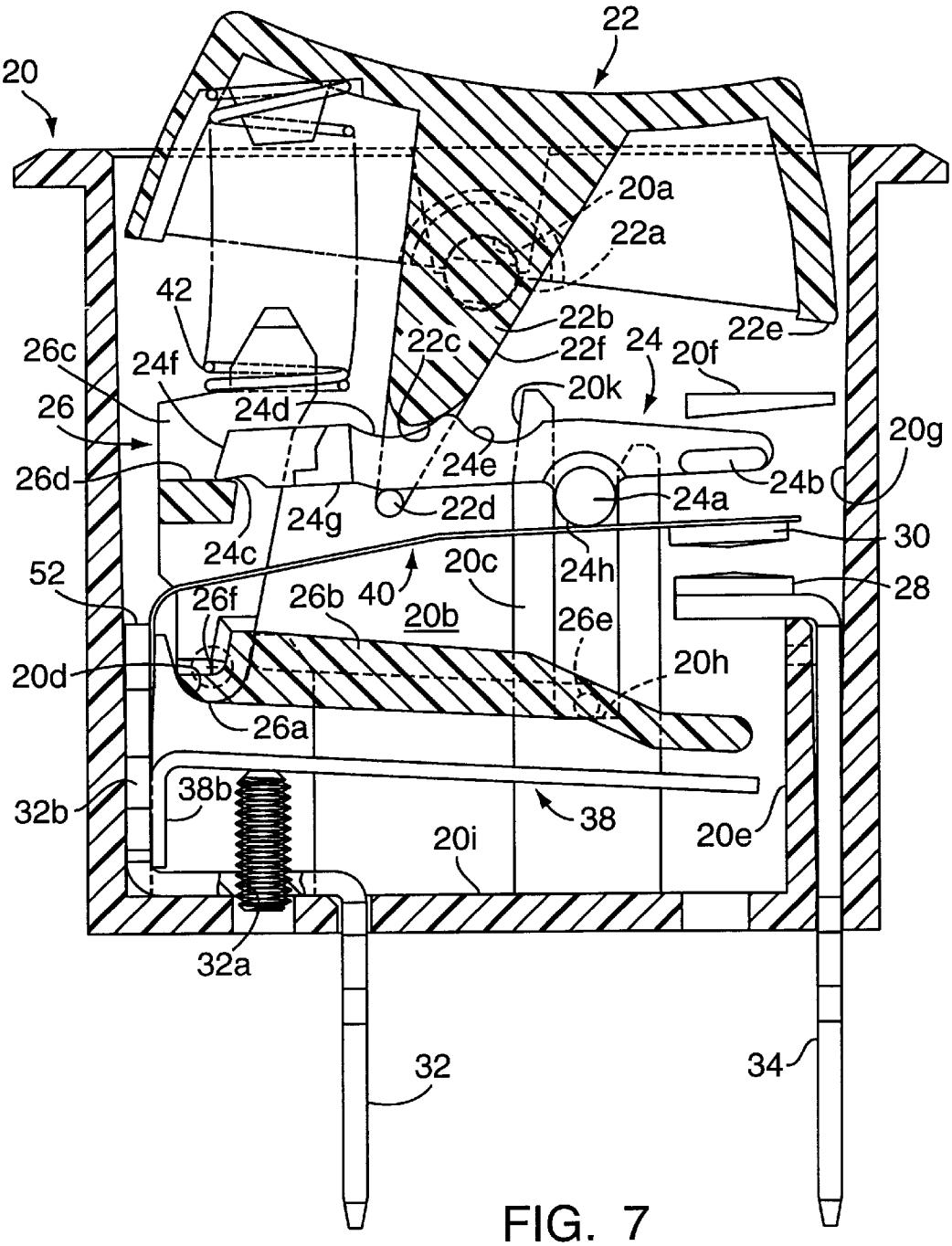
FIG. 7 is a vertical section similar to FIG. 6 and shows the rocker in transit toward the 'on' position, with arrows indicating movement of various components in transit.
Figure 8:
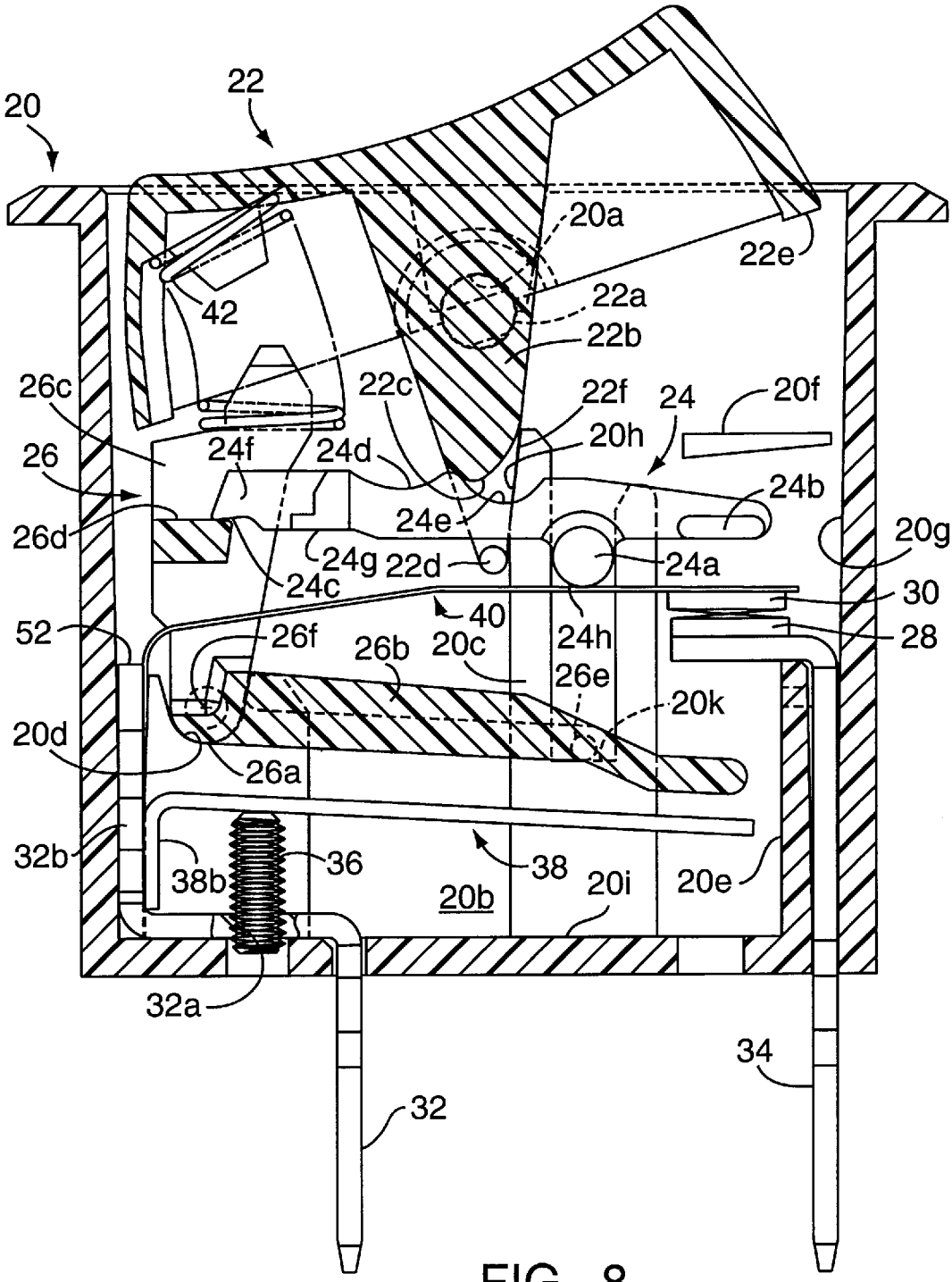
FIG. 8 is a vertical section similar to FIG. 6 and shows the rocker in the 'on' position with no overload condition.
Figure 9:
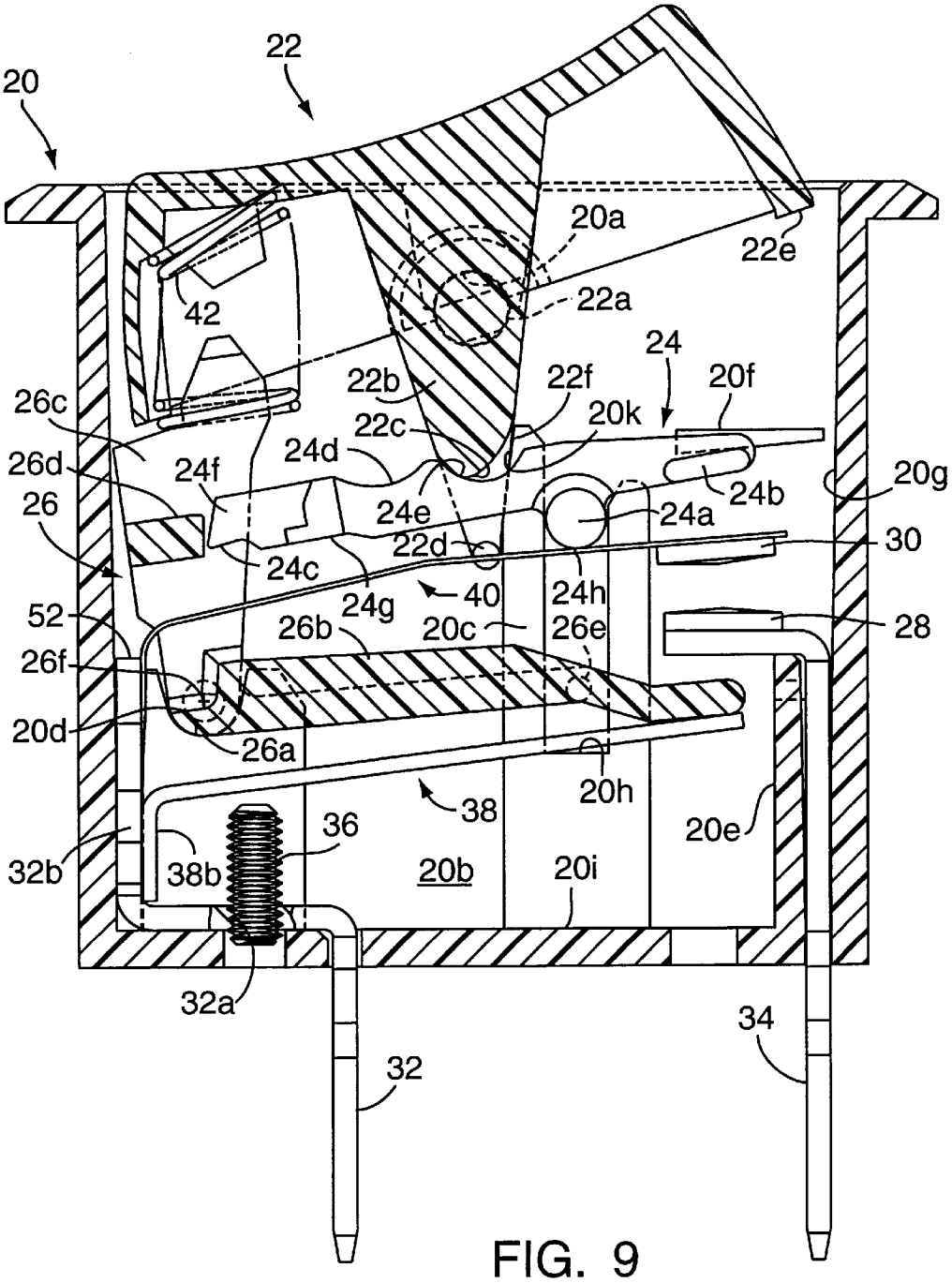
FIG. 9 is a vertical section similar to FIG. 6 and shows the 'trip free' function in operation. The bi-metallic element is deflected upwards due to an overload condition while the rocker is being manually held in the 'on' position.

The trip actuator 26 is of an "L" shape with horizontal and vertical legs (26*b* and 26*c*, respectively), and wherein the horizontal leg 26*b* is positioned between the movable contact arm 40 and the bi-metallic element 38. Axle defining projections 26*a* on the trip actuator pivotally support it in the molded socket 20*d* defined by the housing. The trip actuator's vertical legs 26*c* rise above a surface 26*d* which normally engages the notch 24*c* of the contact actuator to prevent downward movement of that end of the contact actuator. The rocker extension lower surface 22*c*, when rotated counterclockwise (as shown), acts upon the engagement surface 24*d* of the contact actuator so that the contact actuator 24 will pivot at the point where it abuts the surface 26*d* of the trip actuator. This pivot action will move the right end (as shown) of the contact actuator 24 and thereby drive down the pressure point surface 24*h* against the _15 movable contact arm 40 to close the contact elements (28 and 30). The surface 26*d* of the trip actuator 26 moves out from under the notch 24*c* of the contact actuator and will no longer support that end of the contact actuator 24 when the trip actuator 26 has pivoted or 'tripped' (counterclockwise as shown in FIG. 9) due to the upward movement of an over-heated bi-metal 38. The trip actuator 26 is provided with pin projections 26*e* that will abut the bottom 20*h* of the tracks 20*c* to limit downward rotation of said trip actuator in the normal 'reset' direction (clockwise as shown in FIGS. 6, 7, & 8).

Figure 6:
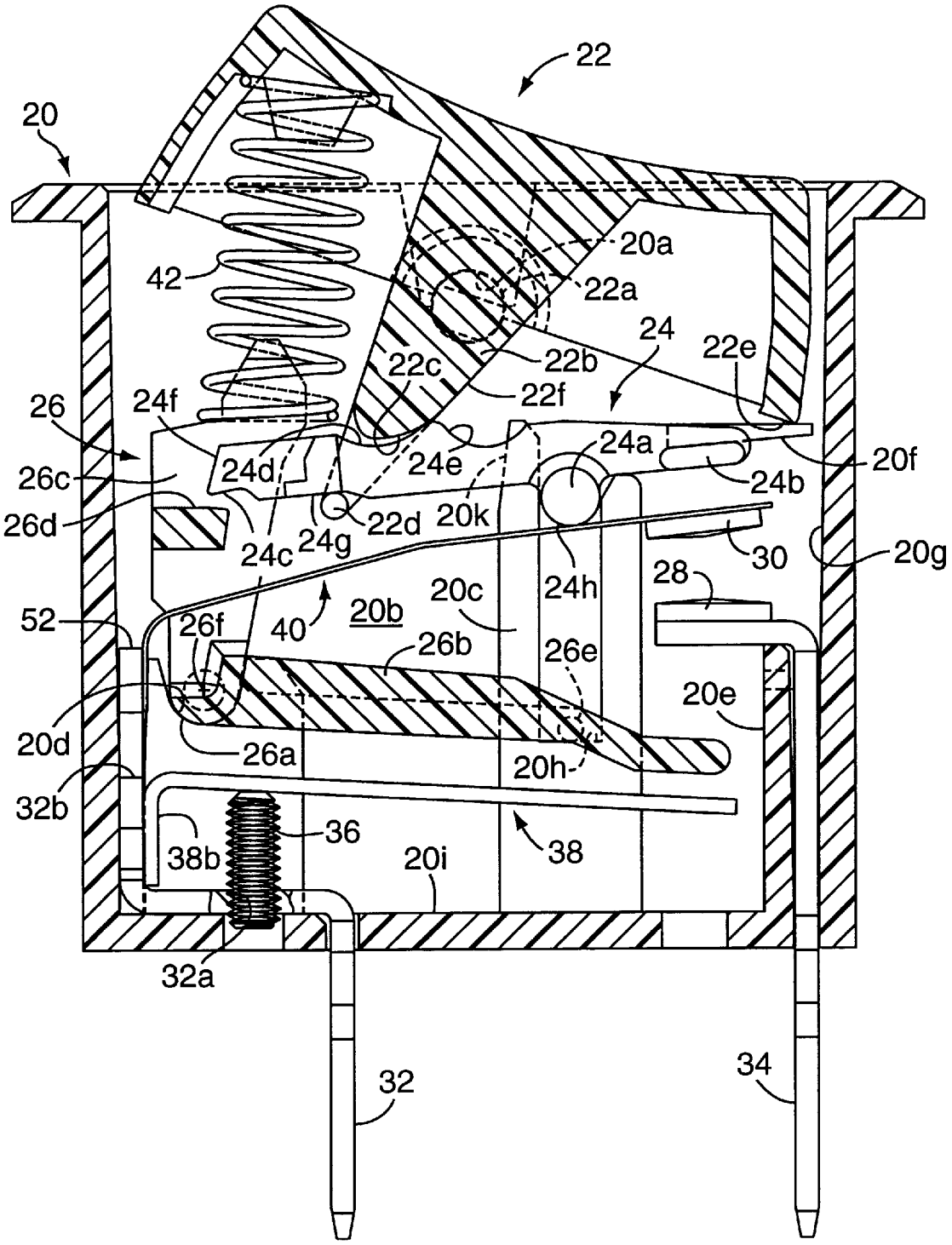
FIG. 6 is a vertical section of the preferred embodiment of the invention, and shows the rocker in the 'off' position, the contacts open, and no deflection of the bi-metallic element.

A compression spring 42 is provided between the top of the trip actuator's vertical leg 26*c* and the lower surface of the rocker 22, biasing said rocker toward the 'off' position (FIG. 6). The spring 42 is so oriented that the spring force vector always passes slightly inboard of the trip actuator's pivot axis (shown generally at 26*f*), thereby always biasing the trip actuator to the normal, or reset position.

Figure 12:
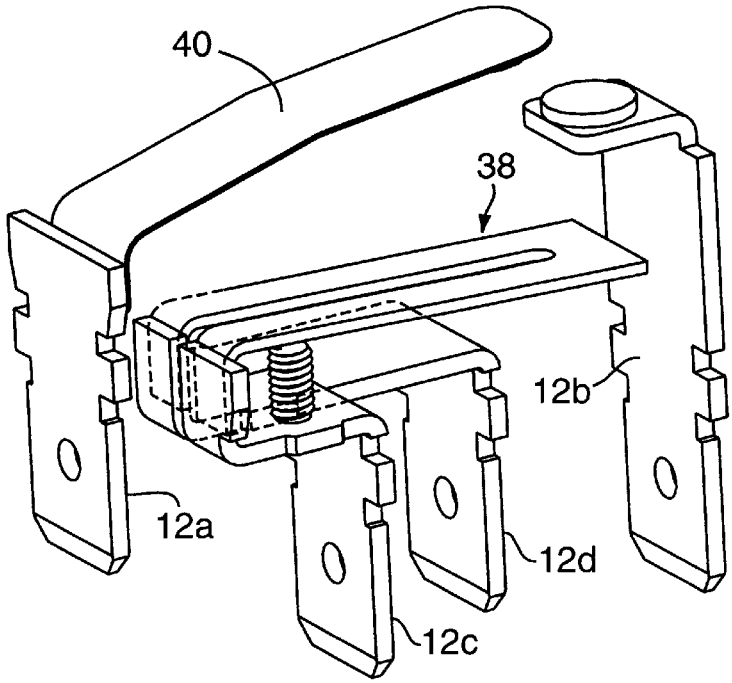
FIG. 12 is similar to FIG. 11 showing an alternative embodiment with the bi-metallic independent of the switch circuit to allow remote activation of the bi-metal to open the switch circuit.

An alternative embodiment is shown in FIG. 12, wherein the bi-metal 38 is completely separate from the switch circuit between terminals 12*a* and 12*b*, and has independent terminals 12*c* and 12*d*. The bi-metal may thereby be connected to a circuit to enable the switch circuit to be opened by applying an overload current to the bi-metal from a remote source.

Figure 13:
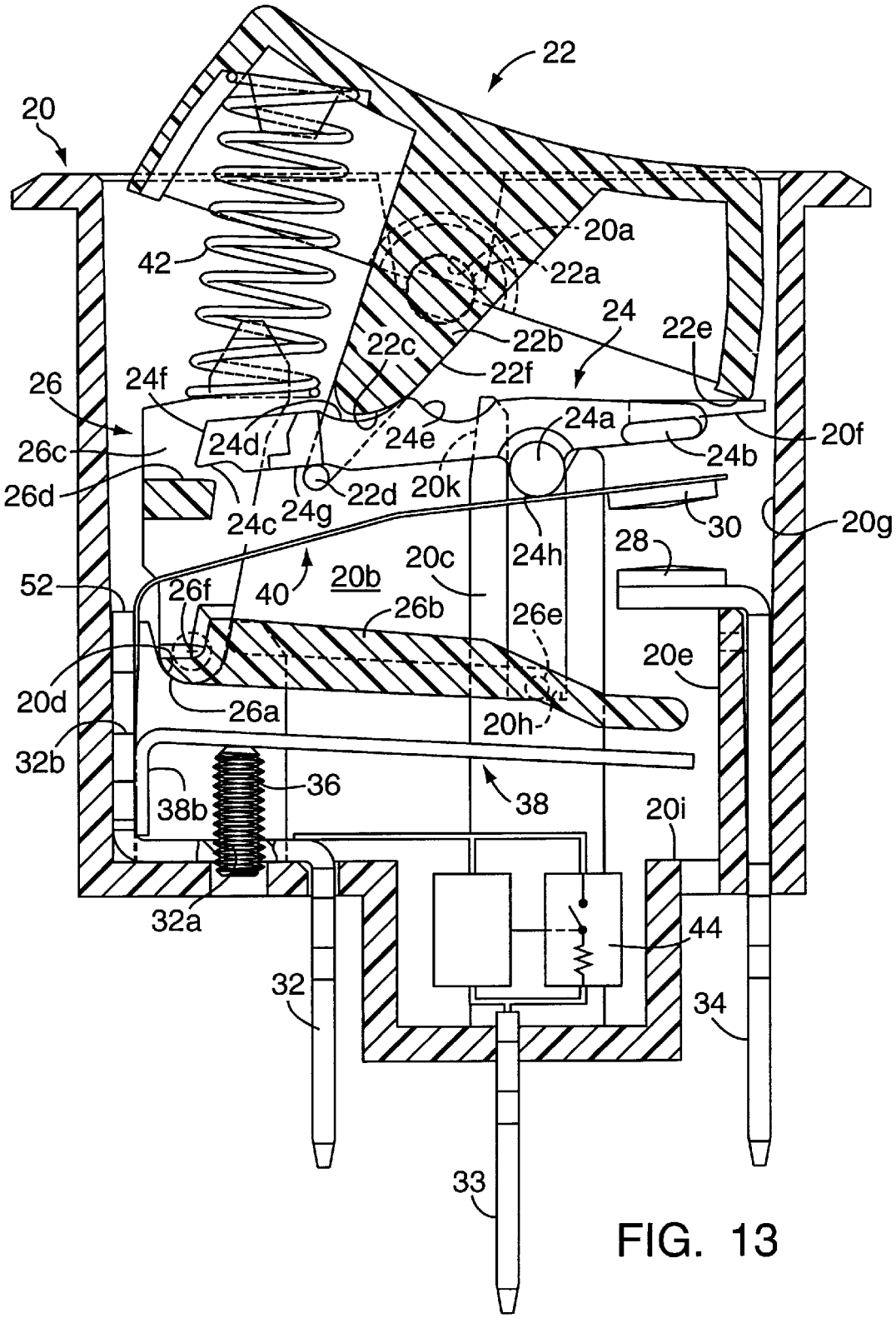
FIG. 13 is a vertical section showing a second alternative embodiment incorporating a solid state sensor and switching circuit to activate the bi-metallic element, thereby providing features in addition to the bi-metallic elements normal overcurrent protection.
Figure 14:
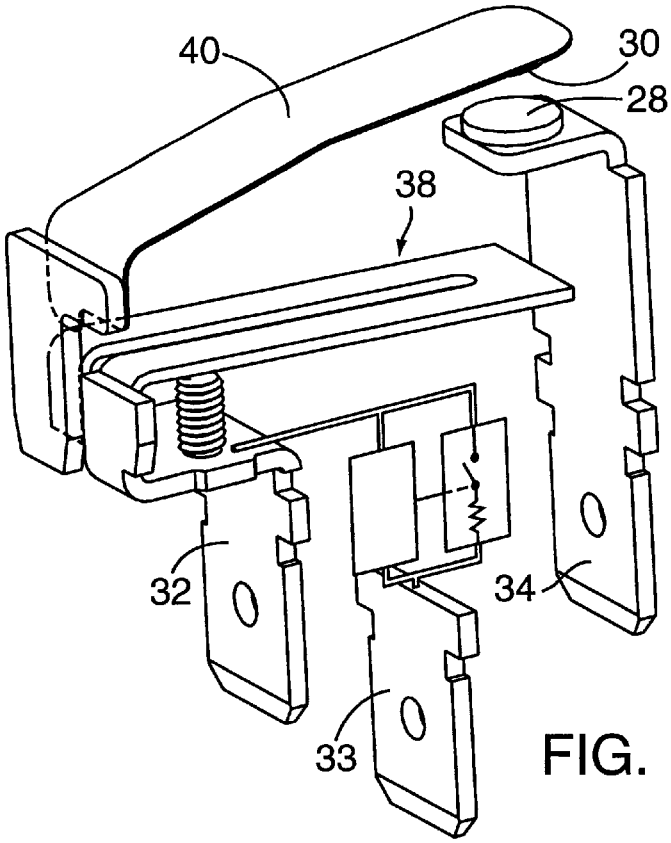
FIG. 14 is a perspective view of the electrically conductive components of a third alternative embodiment.

A second alternative embodiment is shown in FIGS. 13 and 14, wherein a solid state sensor 46 detects the reaching of a particular voltage limit in the circuit, or alternatively, the reaching of a designated pre-programmed time limit after the switch circuit has been closed. When said sensor's pre-programmed limits are reached, the sensor circuit 46 activates a solid state switch circuit 44 to shunt an appropriate amount of current passing through the bi-metal 38 to ground. This current being shunted through the bi-metal to ground will be adequate to cause the bi-metal to overheat, thereby resulting in the bi-metal's activating the trip actuator and opening the contacts 28 and 30 of the switch circuit. Thus the bi-metal not only provides the normal current protection feature, but at the same time serves as the driving mechanism of the shunt circuit 44 to effect an opening of the switch contacts when directed by the sensor 46. While numerous conditions can be monitored, depending upon the programming of the solid state sensor, the bi-metal's shunt-to-ground placement of the solid state switch 44 is the significant feature, as this still allows the bi-metal to perform its normal function of overcurrent protection. Many alternative or combined conditions may be monitored by the sensor, such as time, ground faults, low or fluctuating voltage, etc.

Figure 15:
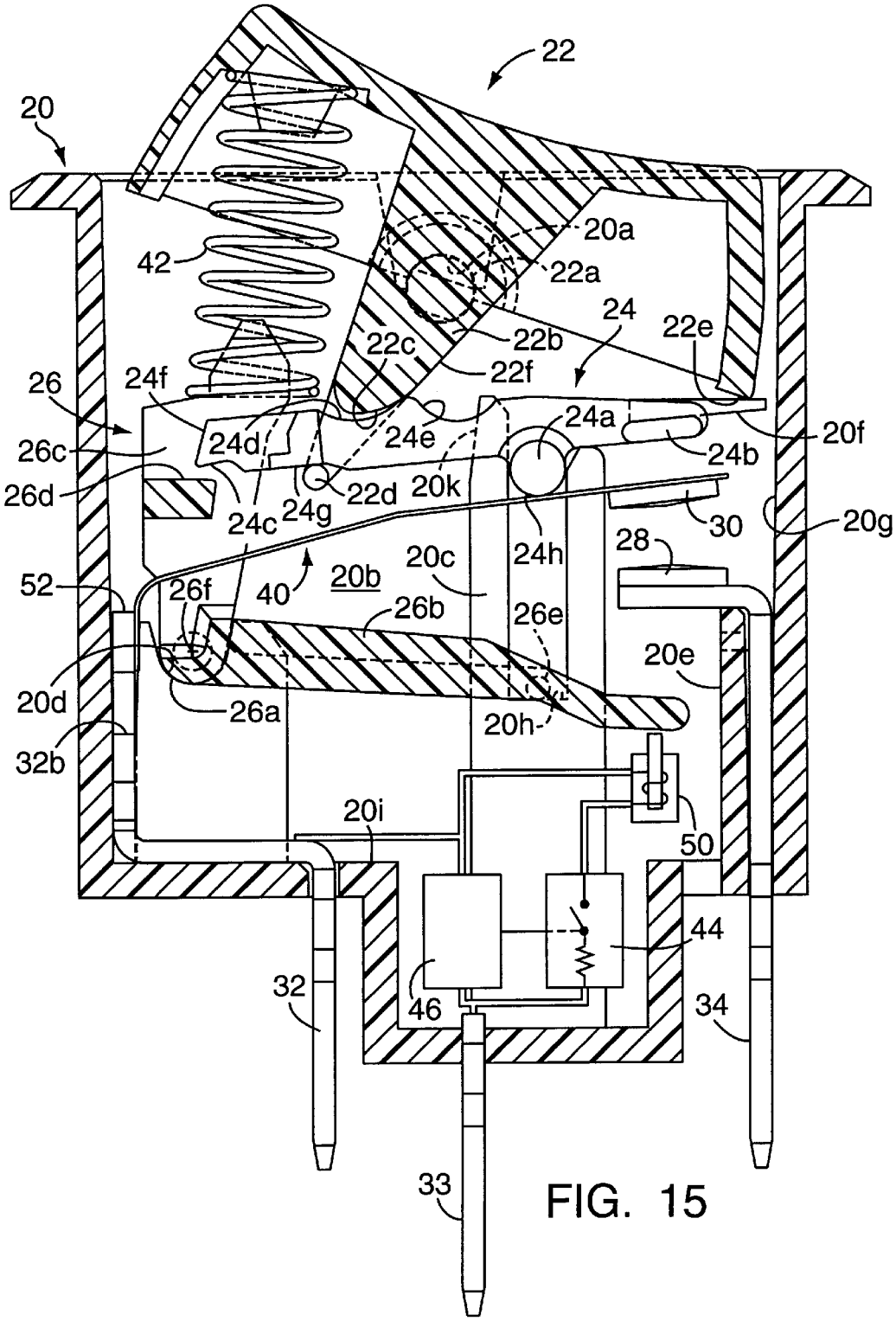
FIG. 15 is a vertical section showing a fourth alternative embodiment where a solenoid replaces the bi-metallic element.

A third alternative embodiment is shown in FIG. 15 wherein a solenoid 50 has its armature arranged to exert force against the trip actuator 26, causing the circuit to open. The solenoid 50 takes the place of the bi-metal in the version with the solid state sensor and is employed as an alternative means to actuate the trip actuator. This embodiment eliminates the need for the calibration screw 36 and its threaded opening 32*a*.

Figure 16:
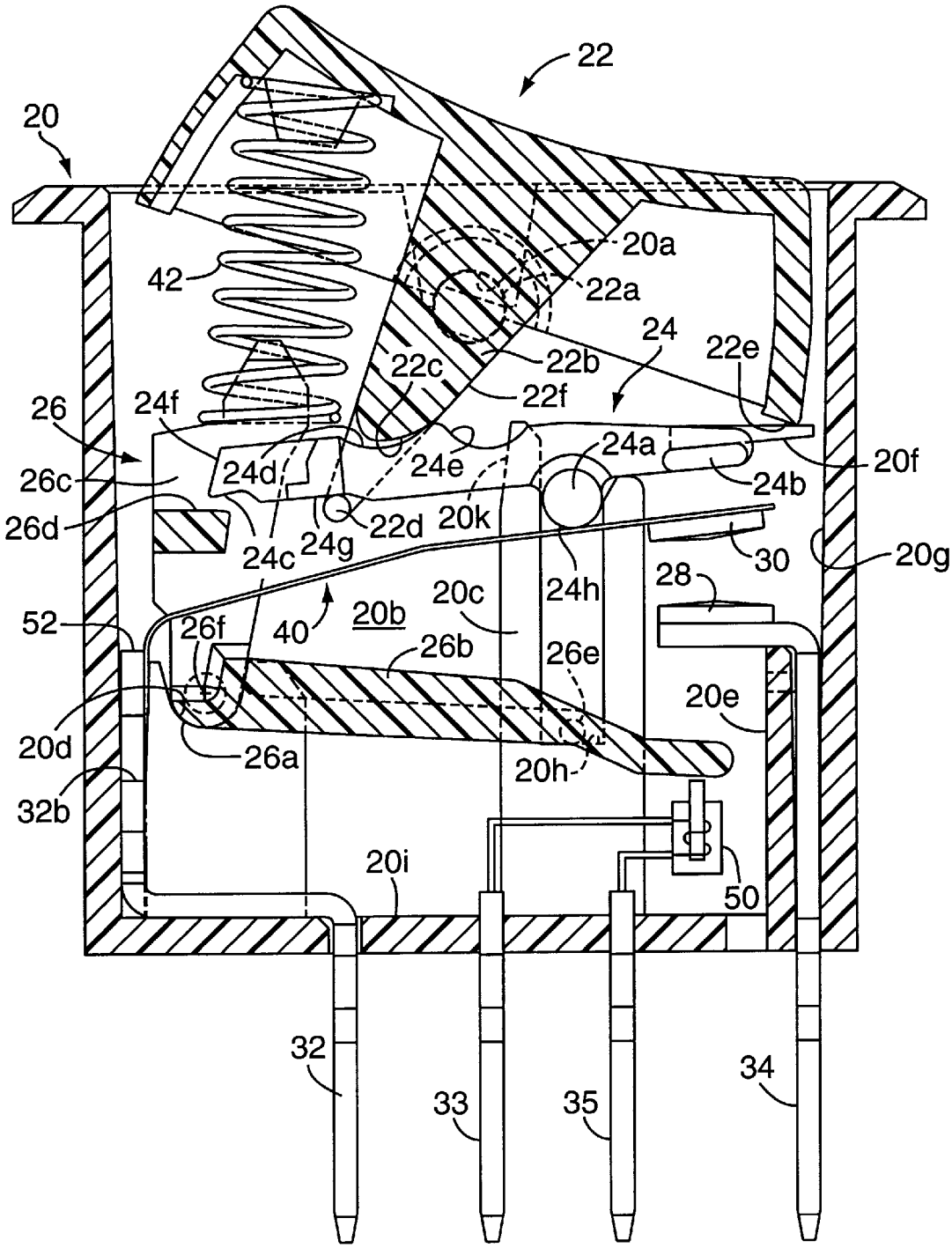
FIG. 16 is similar to FIG. 15 but showing an alternative embodiment incorporating a solenoid for remote operation of the device.

FIG. 16 shows a fourth alternative employing a solenoid 50 controlled by a remote trip circuit which would be connected to terminals 33 and 35.

Figure 18:
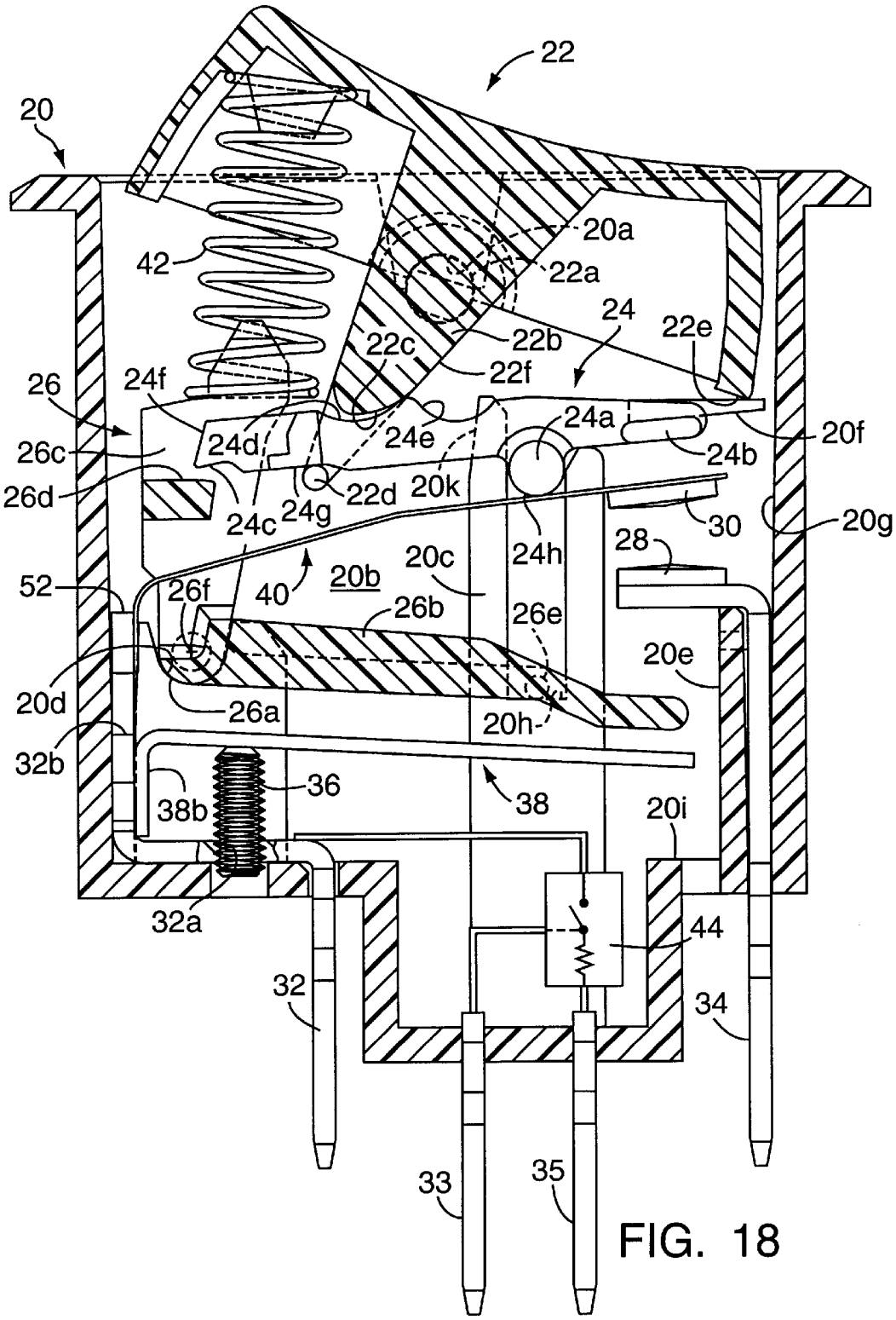
FIG. 18 is a fifth alternative embodiment of the invention using a bi-metallic element that is operated by a solid state switch without the solid state sensor of FIG. 17. This setup allows for remote tripping of the device as in FIG. 16.

FIG. 18 shows a fifth alternative employing the bi-metallic element with a solid state switch 44 but without a solid state sensor circuit. The solid state switch in this version may be controlled by a remote sensor circuit which would apply a signal to terminal 35 to activate the solid state switch 44, causing it to shunt a controlled current passing through the bi-metallic element to ground, or neutral, and thereby trip the mechanism, opening the mechanical switch.

Figure 19:
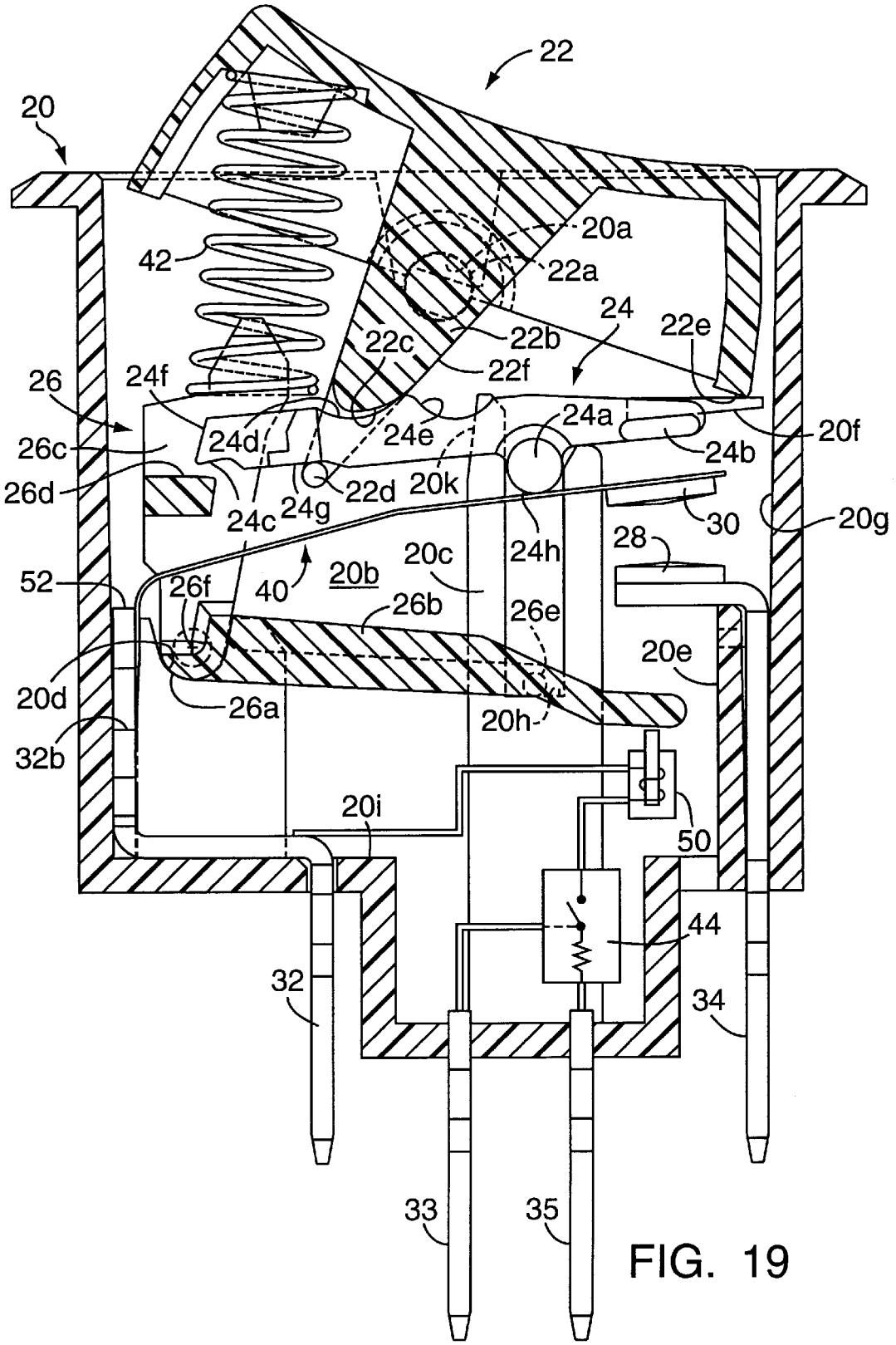
FIG. 19 is a sixth alternative embodiment employing a solid state switch in a solenoid operated device such as that shown in FIG. 15.

FIG. 19 shows a sixth alternative employing a solenoid in place of the bi-metallic element with the solid state switch 44. The solid state switch would, as in FIG. 18, be controlled by a remote sensor circuit which would apply a signal to terminal 35 to activate the solid state switch 44 causing it to apply current to the solenoid and thereby trip the mechanism, opening the mechanical switch.

Any of the above embodiments may also be incorporated into a double or multi pole thermal circuit breaker and switch whereby a single trip action by a bi-mettalic element or solenoid in any one or more of the poles causes all the embodied poles to open. Such a multi-pole function would include two or more thermal circuit breaker and switch circuits mounted side by side in one housing. Common tripping of the multi-poles would be effected by the use of either a single trip actuator serving multi-poles or by interconnecting separate trip actuators at each pole by linking them with a connecting pin or rod.

FIG. 6 shows the rocker 22 in the spring biased 'off' position, the trip actuator 26 in the 'reset' position, and the left end of the contact actuator 24 abutting the trip stop 26*d* of said actuator. The upward bias of the movable contact arm 40 pushes the contact actuator 24 upwards until the actuator stop 24*b* abuts the housing stop 20*f*. Said housing stop 20*f* may alternatively be provided by an additional part or by an extension of the second terminal 34. The left end of the contact actuator 24 is held in position by the trip stop 26*d* and the rocker extension's lower surface 22*c*. The optionally employed inward facing projections 22*d* on the rocker extension 22*b* movably engage the lower surface 24*g* of the contact actuator 24.

FIG. 7 shows the invention with the rocker 22 in transit towards the 'on' position with pressure applied to the left (as shown) portion of said rocker. Rotation of the rocker causes the lower surface 22*c* to travel across the contact actuator surface 24*d*, depressing the contact actuator in a downward clockwise direction as it pivots at the left end 24*f* (as shown) which is held in place by the trip stop 26*d*. The contact actuator 24 thereby transfers downward pressure at 24*h* to the contact arm 40 causing the contact arm 40 to move downward and close the contact elements 28 and 30.

FIG. 8 shows the device in the closed circuit position with no overload condition. The rocker 22 is fully depressed to the 'on' position, wherein the rocker extension lower surface 22*c* rests in the 'on' position detent 24*e* of the contact actuator 24, and said contact actuator holds the movable contact arm 40 against its bias so that the contact elements (28 and 30) connect. The bias of the compression spring 42 is insufficient to overcome the resistance of the rocker extension lower surface 22*c* in the 'on' position detent 24*e* of the contact actuator 24.

FIG. 9 shows the device in the open-circuit position during an overload condition despite the rocker 22 being manually held to the 'on' position. During an overload condition, the device is subjected to an electrical load greater than its rating, causing the bi-metallic element 38 to heat up and curve upwards and engages the trip actuator's horizontal leg 26*b*. Such engagement and the bias of the element 38 itself overcomes the compression spring's 42 bias and causes the trip actuator to pivot around its axle projections 26*a* that rest in the molded housing socket 20*d*. Consequently, the trip actuator's vertical legs 26*c* rotate outboard (counter-clockwise as shown in FIG. 9) toward the housing end wall opposite of wall 20*g*. Such rotation moves the trip stop 26*d* out of contact with the corresponding lower end surface 24*c* (left as shown) of the contact actuator 24. Since the end 24*f* (left as shown) is now free of restriction, said end drops downward as the upward bias of the contact arm 40 causes the contact actuator 24 to pivot counter-clockwise (as shown) about the surface 22*c* of the rocker. The stops at end 24*b* then come to rest abutting the housing stops 20*f*. This shifts the plane of the contact actuator and disengages the contact actuator's 'on' position detent 24*e* from the rocker's surface 22*c*. The rocker is thereby left unrestricted and is then free to return to its normally biased 'off' position.

Figure 2:
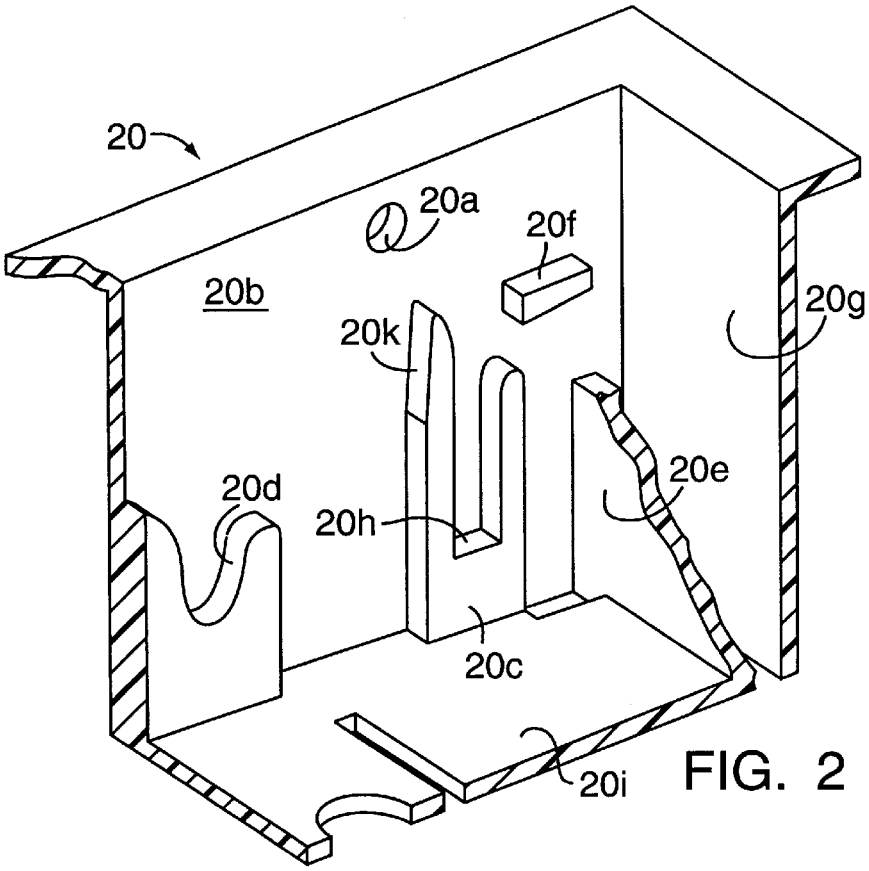
FIG. 2 is a cutaway view of the housing in isolation.
Figure 3:
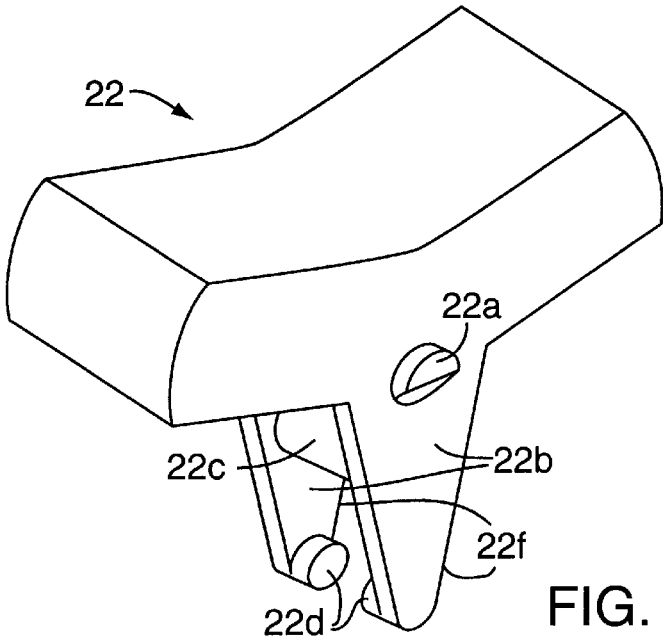
FIG. 3 is a view of the rocker or operator in isolation.
Figure 4:
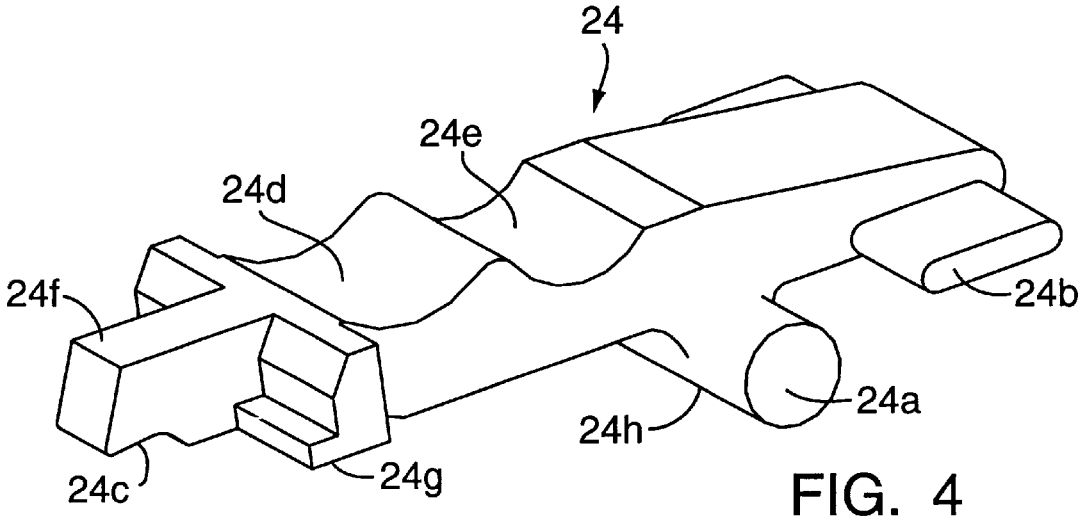
FIG. 4 is a view of the contact actuator in isolation
Figure 5:
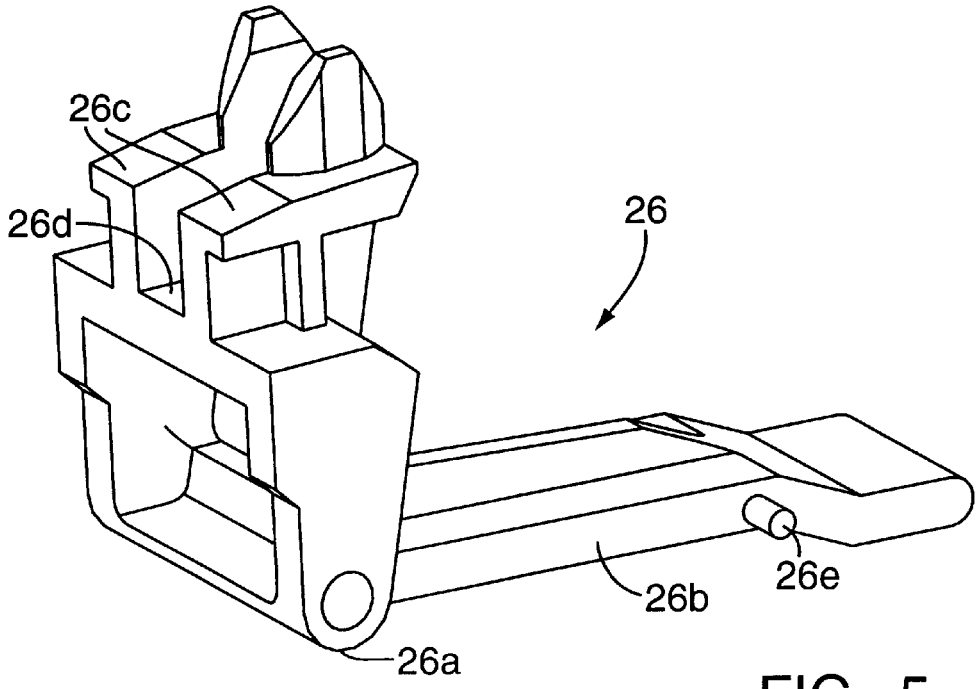
FIG. 5 is a view of the trip actuator in isolation.
Figure 10:
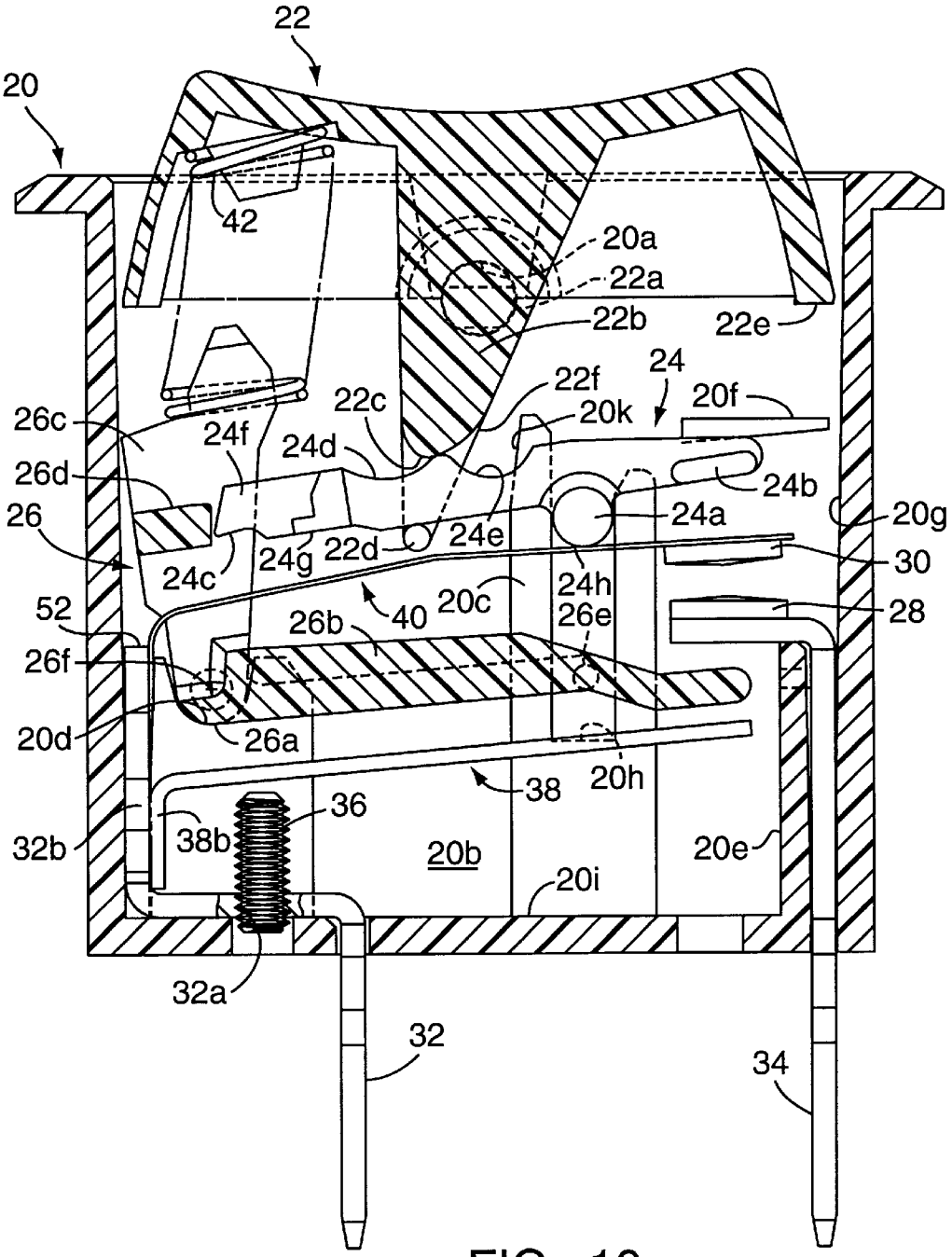
FIG. 10 is a vertical section similar to FIG. 9 and shows the rocker in transit toward the 'off' position, with arrows indicating movement of various components in transit.

FIG. 10 shows the invention with the rocker 22 in transit after an overload condition. The compression spring 42 drives the rocker to the 'off' position, after the rocker surface 22*c* is set free from engagement by the contact actuator detent 24*e*, due to the contact actuator 26 having rotated counter-clockwise (as shown) when the trip actuator surface 26*d* moves out from under surface 24*c*. The contact actuator 24 then pivots on stops 24*b* abutting the housing projections 20*f*, causing the opposite end 24*f* (left as shown) of the contact actuator to rise about surface 26*d* of the trip actuator. As the bi-metallic element 38 cools and returns to its undeflected shape, the trip actuator 26 rotates (clockwise as shown) back to the position shown in FIG. 2 due to the compression spring 42 bias and surface 26*d* moves underneath surface 24*c* of the contact actuator. The device is then reset back to the position shown in FIG. 6.

Figure 17:
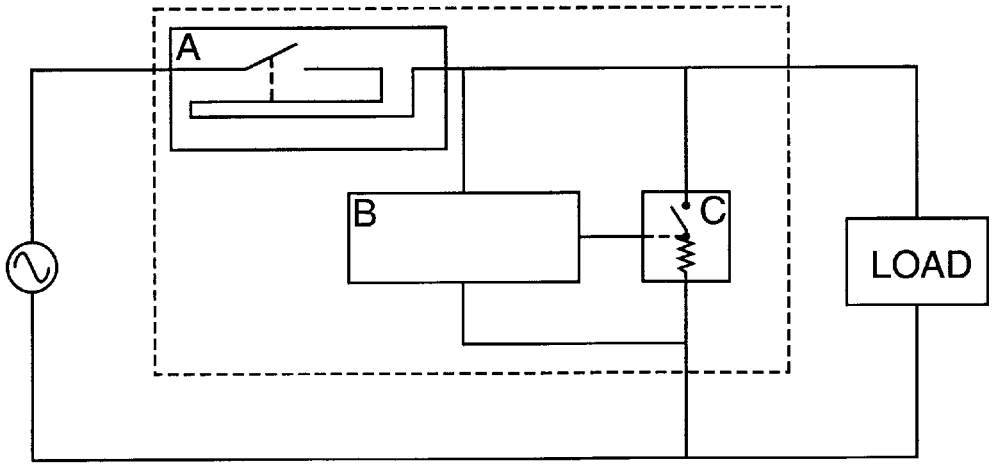
FIG. 17 is a block diagram of a circuit incorporating a circuit breaker and switch showing a control circuit, and a gate controlled switch for tripping the breaker/switch.

FIG. 17 shows in block diagram form a circuit incorporating any of the devices (A) previously disclosed. The control circuitry (B) senses conditions comprising overvoltage, ground fault, temperature, undervoltage, time, or any combination thereof. A gate controlled switch (C) operates in response to the output from the control circuit (B). As shown, the thermal circuit protector and switch accompanying sensors are in the 'off', inactive position.

A multi-pole version of the FIG. 1 device is suggested in that view, wherein another similar device is provided alongside that shown so that a connecting rod or its equivalent can be provided at the pivot axis for the trip actuator to extend through an opening in the housing side wall(s) for connection to the trip actuator 27 in an adjacent device or pole.

I claim:

1. A device having both circuit breaker and circuit switching functions, said device comprising:

a molded housing defining a hollow cavity with at least one side wall defining a track, and said housing also defining a socket spaced from said track;

a fixed contact, and a movable contact;

a contact arm having a fixed end electrically connected to said movable contact provided at its free end, and said contact arm serving to normally bias said movable contact away from said fixed contact;

a manually movable switch operator having an extension projecting into said cavity, said operator being movable between 'on' and 'off' positions;

a contact actuator having at least one laterally projecting portion slideably received in said track of said housing side wall, said operator extension being engageable with said contact arm for moving said contact arm between 'on' and 'off' positions;

a trip actuator movably mounted in said socket and having an upstanding leg normally engaging one end of said contact actuator when said trip actuator is in its normal position to allow normal switching of said operator and contact actuator to achieve said 'on' and 'off' movement of said contact arm;

means responsive to a predetermined electrical condition in a circuit containing said fixed and movable contacts for shifting said trip actuator out of said normal operating position and disengaging said upstanding leg of said trip actuator from said contact actuator to prevent said switch operator from effecting said 'on' and 'off' movement of said contact arm.

2. The device according to claim 1 wherein said means responsive to a predetermined electrical condition for so shifting said trip actuator out of its normal position comprises a resilient bi-metallic element in electrical series circuit with said contacts, said bi-metallic element having a portion that is deformed by heat in response to an overcurrent condition, said trip actuator having a second leg arranged between said contact arm and said bi-metallic element so that said deformed portion is engageable with and biases said second leg of said trip actuator for urging said trip actuator out of said normal position and thereby disengaging said upstanding leg as aforesaid.

3. The device according to claim 2 further characterized by biasing means acting between said upstanding leg of said trip actuator and said switch operator to normally return said switch operator to its 'off' position, and said biasing means also acting to urge said trip actuator into its socket.

4. The device according to claim 3 further characterized by at least two terminals that project outside said housing, wherein said bi-metallic element is of generally 'U' shape having a base portion and first and second arm portions, said bi-metallic element first arm portion electrically connected to one terminal and said second arm portion electrically connected to said movable contact, said base portion of said bi-metallic element being resiliently deformable by heat in response to an overcurrent condition.

5. The device according to claim 4 wherein the bi-metallic element further comprises additional terminals for electrically connecting said bi-metal element to other current sources.

6. The device according to claim 4 wherein a solid state sensor and switch is connected from one end of the bi-metallic element to a neutral terminal such that the solid state sensor is able to control shunt current through the bi-metallic element to ground.

7. The device according to claim 6 wherein a solid state switch is connected from one end of the bi-metallic element to a neutral terminal and to a signal terminal such that external to the device a sensor circuit may signal the solid state switch to control shunt current through the bi-metallic element to ground.

8. The device according to claim 1 further characterized by biasing means acting between said upstanding leg of said trip actuator and said switch operator to normally return said switch operator to its 'off' position, and said biasing means also acting to urge said trip actuator into its socket.

9. The device according to claim 8 wherein said means responsive to a predetermined electrical condition for so shifting said trip actuator from its normal position comprises a solenoid having an armature element capable of extending in response to an electrical input, a trip actuator having said second leg thereof arranged between said contact arm and said solenoid element so as to be engageable by said solenoid element when so extended.

10. The device according to claim 9 further characterized by biasing means acting between said upstanding leg of said trip actuator and said switch operator to normally return said switch operator to its 'off' position, and said biasing means also acting to urge said trip actuator into its socket.

11. The device according to claim 9 wherein a solid state sensor and switch is connected from one end of the bi-metallic element to a neutral terminal such that the solid state sensor is able to control shunt current through the bi-metallic element to ground.

12. The device according to claim 11 further comprising a solid state sensor circuit wherein said solid state sensor circuit is connected to a solid state switch circuit which is connected to the solenoid such that the solid state switch circuit controls current to the solenoid.

13. The device according to claim 12 wherein the solid state switch further comprises additional terminal connections to electrically connect remote sensors, such that the remote sensors may electrically signal the solid state switch to apply current to the solenoid.

14. The device according to claim 1 further comprising at least one additional device alongside said device, and a common trip connection between said devices such that movement of one trip actuator effects movement of at least one additional trip actuator.

15. The device according to claim 14 wherein said common trip connection comprises a connecting rod extending across adjacent housings through openings to positively interconnect said trip actuators.

16. The device according to claim 15 wherein said rod defines the pivotal axes of the trip actuators in said adjacent side-by-side device housings.

17. The device according to claim 14 wherein said common trip connection comprises a trip actuator having trip actuator portions that extend through the adjacent housings and impart rotational movement of said trip actuator portions in said adjacent housings.

18. The device according to claim 1 further comprising a circuit breaker a switch device and a control circuit including a gate controlled switch, said gate controlled switch operating on said circuit breaker to electrically trip said breaker in response to predetermined electrical conditions sensed by said control circuit such as undervoltage, overvoltage, fluctuating voltage, elapsed time, or any combination thereof.

19. The combination of claim 18 wherein the gate controlled switch shunts current across the circuit breaker causing it to trip.

20. In the device according to claim 1, wherein said means responsive to a predetermined electrical conditions is a current sensing means, the improvement comprising:

a solid state control circuit for monitoring the electrical current in the device, and generating an output signal in response to a predetermined electrical parameter exhibiting a value outside of predetermined limits, and a controlled switch operable in response to said output signal for shunting current across said current sensing means to so move said trip actuator and disable said contact actuator.

* * * * *

UNITED STATES PATENT AND TRADEMARK OFFICE

CERTIFICATE OF CORRECTION

PATENT NO. : 6,094,126
DATED : July 25, 2000
INVENTOR(S) : Richard W. Sorenson

It is certified that error appears in the above-identified patent and that said Letters Patent is hereby corrected as shown below:

Title page,
Item [57], ABSTRACT,
Line 3, please delete “free”.

Column 3,
Line 36, after “bi-metallic” and insert -- element --.
Line 37, please delete “bi-metal” and insert -- bi-metallic element --.

Column 4,
Line 25, please delete “upper end”.

Column 5,
Line 46, please delete “20h” and insert -- 20c --.

Column 7,
Line 39, please delete “24f” and insert -- 24c --.
Line 45, please delete “and”.
Line 54, please delete “26” and insert -- 22 --.

Signed and Sealed this

Twelfth Day of October, 2004

JON W. DUDAS
*Director of the United States Patent and Trademark Office*